US011619894B2

(12) United States Patent
Saito

(10) Patent No.: US 11,619,894 B2
(45) Date of Patent: Apr. 4, 2023

(54) IMAGE FORMING APPARATUS

(71) Applicant: CANON KABUSHIKI KAISHA, Tokyo (JP)

(72) Inventor: Shuji Saito, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/467,531

(22) Filed: Sep. 7, 2021

(65) Prior Publication Data

US 2022/0091543 A1 Mar. 24, 2022

(30) Foreign Application Priority Data

Sep. 23, 2020 (JP) ..... JP2020-158687

(51) Int. Cl.
*G03G 15/16* (2006.01)
*G03G 15/01* (2006.01)
*G03G 15/043* (2006.01)

(52) U.S. Cl.
CPC ..... *G03G 15/161* (2013.01); *G03G 15/01* (2013.01); *G03G 15/043* (2013.01)

(58) Field of Classification Search
CPC ..... G03G 15/01; G03G 15/161; G03G 15/043
See application file for complete search history.

(56) References Cited

U.S. PATENT DOCUMENTS

| | | | | |
|---|---|---|---|---|
| 6,856,777 | B2 | 2/2005 | Enomoto et al. | |
| 9,075,352 | B2 | 7/2015 | Seki et al. | |
| 9,599,935 | B2 | 3/2017 | Asai et al. | |
| 2014/0340457 | A1* | 11/2014 | Hashimoto | G03G 21/0094 347/118 |
| 2017/0003623 | A1* | 1/2017 | Noguchi | G03G 15/234 |
| 2019/0275806 | A1* | 9/2019 | Uemura | G03G 15/04054 |
| 2021/0302885 | A1* | 9/2021 | Yagi | G03G 15/161 |

FOREIGN PATENT DOCUMENTS

| | | | |
|---|---|---|---|
| JP | 2011-064741 | A | 3/2011 |
| JP | 2012-194513 | A | 10/2012 |
| JP | 2014-119619 | A | 6/2014 |
| JP | 2016-020970 | A | 2/2016 |
| JP | 2019-159056 | A | 9/2019 |

* cited by examiner

*Primary Examiner* — Carla J Therrien
(74) *Attorney, Agent, or Firm* — Venable LLP

(57) ABSTRACT

An image forming apparatus includes an exposing unit, an intermediary transfer belt, a cleaning blade to clean a remaining toner on the intermediary transfer belt, and a controller to control so as to form a toner image on the intermediary transfer belt to supply toner as a lubricant of the cleaning blade. The controller controls a first line count when a first toner image is formed to supply the toner to the cleaning blade to become fewer than a second line count when a second toner image is formed to transfer to a recording material.

6 Claims, 6 Drawing Sheets

(A)

(B)

IMAGE FORMING APPARATUS

FIELD OF THE INVENTION AND RELATED ART

The present invention relates to an image forming apparatus. In particular, it relates to a copying machine, a printer, etc., which uses an electrophotographic image forming method or an electrostatic recording method, forms a toner image on its image bearing member, transfers the toner image onto its intermediary transferring member, and then, transfers the toner image on the intermediary transferring member, onto a sheet of recording medium.

There have been various image forming apparatuses which use an electrophotographic image forming method. One of them is an image forming apparatus of the so-called intermediary transfer type, which forms a toner image on its photosensitive member, transfers (which hereafter may be referred to as primary transfer), and then, transfers (which hereafter may be referred to as secondary transfer) the toner image on the intermediary transferring member, onto a sheet of transferring medium. An intermediary transfer belt, which is an endless belt, has been widely in use as an intermediary transferring member. In the case of an image forming apparatus of the so-called intermediary transfer type, it sometimes occurs that a certain amount of toner (which hereafter may be referred to as secondary transfer residual toner) remains on the intermediary transfer belt after the secondary transfer. Therefore, it is necessary to remove the secondary transfer residual toner on the intermediary transfer belt (to clean intermediary transfer belt) before transferring the next toner image onto the intermediary transfer belt.

As one of the methods for cleaning an intermediary transfer belt, a cleaning method which employs a cleaning blade is widely in use. This blade-based cleaning method employs a cleaning blade as a cleaning member, which is positioned on the downstream side of the secondary transferring portion in terms of the rotational movement of the peripheral surface of the intermediary transfer belt. A cleaning blade mechanically removes (scraped away) the secondary transfer residual toner from the intermediary transfer belt while the intermediary transfer belt moves, and then, recovers the removed secondary transfer residual toner. Generally speaking, as a material for a cleaning blade, an elastic substance such as urethane rubber is used. A cleaning blade is kept pressed on the intermediary transfer belt, by its cleaning edge, in such an attitude (which hereafter may be referred to as counter direction) that cleaning edge is on the upstream side of its base portion in terms of the rotational direction of the intermediary transfer belt. As toner enters between the cleaning edge and intermediary transfer belt, it functions as lubricant, contributing thereby to satisfactory cleaning of the intermediary transfer belt. On the other hand, if the amount by which toner is fed between the cleaning edge of a cleaning blade and intermediary transfer belt remains rather small for a substantial length of time, for example, in such a case where an image forming apparatus remains low in printing ratio for a substantial length of time, the friction between the cleaning blade and intermediary transfer belt increases, which in turn may cause the edge portion of the cleaning blade to be dragged into the interface between the cleaning blade and intermediary transfer belt, causing thereby the edge portion to be partially broken off and/or be pulled into the interface, making it possible for the intermediary transfer belt to be unsatisfactorily cleaned.

As one of the means for dealing with this problem, there was disclosed a structural arrangement for an image forming apparatus, which provides the cleaning edge of a cleaning blade with toner which is capable of functioning as lubricant, to prevent the aforementioned unsatisfactory cleaning of an intermediary transfer belt (for example, Japanese Laid-open Patent Application No. 2011-064741). In a case where a toner image is formed on an intermediary transfer belt to provide the cleaning edge of a cleaning blade with toner, this toner image on an intermediary transfer belt, which was formed for the lubrication, contacts a secondary transfer roller for transferring an ordinary toner image onto a sheet of recording medium, and adheres to the secondary transfer roller. Thus, while a sheet of recording medium, onto which an ordinary toner image is to be transferred next, is passing through the interface between the intermediary transfer belt and the secondary transfer roller, the so-called "back surface soiling", that is, a phenomenon that the toner, which is remaining adhered to the secondary transfer roller, transfers onto the back surface of the sheet, that is, the opposite surface of the sheet from the one, onto which an ordinary toner image has just been transferred, sometimes occurs. In order to prevent the toner from a toner image for lubrication, from adhering to a secondary transfer roller, there have been disclosed an image forming apparatus which separates the secondary transfer roller from the intermediary transfer belt, or to apply to a secondary transfer roller, such voltage that is opposite in polarity from the one which is applied for the secondary transfer of an ordinary toner image. Further, there has been disclosed an image forming apparatus which supplies the cleaning edge of a cleaning blade with such an amount of toner that is substantially smaller compared to the one by which toner is brought to an intermediary transfer belt during the normal secondary transfer, for every predetermined number of sheets of recording medium, through the process for forming a half-tone image, to improve an image forming apparatus not only in the intermediary transfer belt cleaning performance, but also, to prevent the back soiling of a sheet of recording medium (for example, Japanese Laid-open Patent Application No. 2014-119619).

SUMMARY OF THE INVENTION

In a case where an image forming apparatus is structured so that the cleaning edge of its cleaning blade is supplied with a small amount of toner for the lubrication, through the process for forming a half-tone image, as it has been in the past, a half-tone image for lubrication has to be reduced in printing ratio, in a case where such recording medium that makes the back soiling visually more conspicuous than the other recording media is used. However, it is sometimes difficult to reliably form such a half-tone image that is low enough in print ratio to make the back soiling of such a sheet of recording medium that makes its back soiling visually conspicuous. In such a case, if the amount by which toner is supplied to the edge of a cleaning blade is unexpectedly small, friction increases between an intermediary transfer belt and cleaning blade, making it possible for the edge portion of a cleaning blade to partially break off, and/or to be pulled into the interface between the cleaning blade and intermediary transfer belt. On the other hand, if the amount by which toner is supplied to the edge of a cleaning blade is unexpectedly large, it is possible for a recording medium to be soiled on its back surface.

The present invention was made in consideration of the situations described above. Thus, its primary object is to prevent a sheet of recording medium from being soiled on its back surface, while keeping the cleaning blade stable in cleaning performance.

According to an aspect of the present invention, there is a provided an image forming apparatus comprising: an image bearing member; an exposing unit including a light source and configured to form an electrostatic latent image on said image bearing member with a light beam emitted from said light source; a developing member configured to develop the electrostatic latent image formed by said exposing unit with toner and to form a toner image; an intermediary transfer member to which the toner image on said image bearing member is transferred; a primary transfer member configured to transfer the toner image on said image bearing member to said intermediary transfer member; a secondary transfer member configured to transfer the toner image on said intermediary transfer member to a recording material; a cleaning member configured to clean a remaining toner on said intermediary transfer member after transferring the toner image to the recording material by said secondary transfer member; and a controller configured to control so as to form the toner image on said intermediary transfer member to supply the toner as a lubricant of said cleaning member, wherein said controller controls a first line count when a first toner image is formed to supply the toner to said cleaning member to become fewer than a second line count when a second toner image is formed to transfer to the recording material.

Further features of the present invention will become apparent from the following description of exemplary embodiments (with reference to the attached drawings).

DESCRIPTION OF THE EMBODIMENTS

Hereinafter, the present invention is described in detail with reference to a few of preferred embodiments of the present invention and appended drawings. By the way, in the following description of the present invention, the widthwise direction of the intermediary transferring member is the same as the direction (which hereafter may be referred to as primary scan direction) in which the beam of laser light projected from the light source of an exposing unit is moved to scan an image bearing member. The direction which is perpendicular to the primary scan direction is referred to as the secondary scan direction, which is the same as the one in which an intermediary transferring member is rotationally moved.

[Structure of Image Forming Apparatus]

Figure 1:
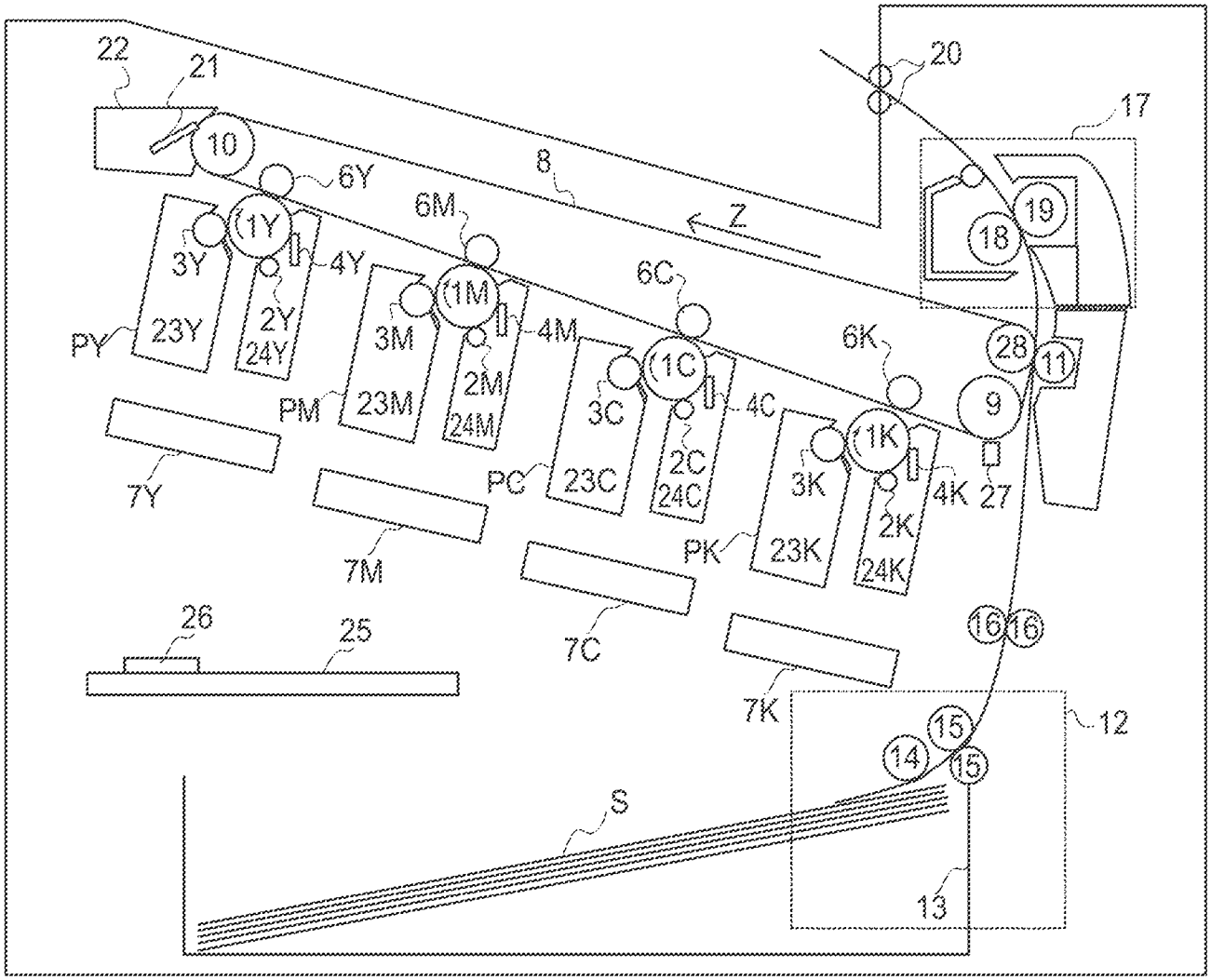
FIG. 1 is a schematic sectional view of the image forming apparatus in the first and second embodiments of the present invention, respectively; it shows the general structures of the apparatuses.

FIG. 1 is a sectional view of the image forming apparatus in the first embodiment of the present invention, at a plane which is parallel to the front surface of the image forming apparatus. It shows the general structure of the apparatus. The image forming apparatus in the first embodiment is such an apparatus that has the following performance. It is 310 mm/s in process speed, 60 ppm in throughput in terms of LTR size sheet of recording medium (number of prints which it can output per unit length of time), and 600 dpi in resolution. It is a laser beam printer (electrophotographic printer) which is capable of dealing with a legal size sheet of recording medium. By the way, a sheet of recording medium which is usable by an image forming apparatus capable of dealing with a legal size sheet of recording medium is 215.9 mm in the maximum width, and 355.0 mm in the maximum length. Here, the "width" of a sheet of recording medium means the measurement of the sheet in terms of the direction perpendicular to the direction in which a sheet of recording medium is conveyed. The "length" of a sheet of recording medium means the measurement of the sheet in terms of the direction in which a sheet of recording medium is conveyed.

The image forming apparatus shown in FIG. 1 is equipped with process cartridges PY, PM, PC and PK, which are removably installable in the main assembly of the apparatus. The four process cartridges PY, PM, PC and PK are the same in structure. They are different only in the color of the toners they store. That is, process cartridges PY, PM, PC and PK use yellow (Y), magenta (M), cyan (C) and black (K) toners, respectively, to form an image. By the way, in the following description of the present invention, the suffixes Y, M, C, and K which indicate colors are omitted unless it is necessary to mention "color". Cartridge P has a toner container 23. Further, the image forming apparatus has multiple photosensitive drums 1 (first, second, third and fourth image bearing members), multiple charge rollers 2, multiple development rollers (developing members) 3, multiple drum cleaning blades 4, and multiple waste toner containers 24.

The image forming apparatus is provided with multiple laser units 7, which are exposing units and are positioned below process cartridges P, one for one. The laser unit 7 exposes a photosensitive drum 1 in accordance with the information of the image to be formed. It has a light source which projects a beam of laser light. As predetermined negative voltage is applied to the charge roller 2, the photosensitive drum 1 becomes charged to a predetermined negative potential level. Then, an electrostatic latent image is formed on the negatively charged portion of the peripheral surface of the photosensitive drum 1 by the laser unit 7. The electrostatic latent image on the photosensitive drum 1 is reversely developed into a toner image by the application of a predetermined negative voltage to the development roller 3. As a result, monochromatic (Y, M, C and K) toner images are formed on is photosensitive drums 1Y, 1M, 1C and 1K, one for one. Each laser unit 7 in the first embodiment has a light source which has four light emitting points. Thus, a single movement of the laser unit 7 from one end of the photosensitive drum 1 to the other end in terms of the direction parallel to the axial line of the photosensitive drum 1 exposes the peripheral surface of the photosensitive drum 1 with four beams of laser light. This movement of the laser unit 7 is repeated to form an image. By the way, the toner used by the image forming apparatus in the first embodiment is a mixture of particulate toner which is 6.4 μm in average particle diameter, and external additive, more specifically, micro-particles of silica, which are 20 nm in average particle diameter. It remains negatively charged. "Average particle diameter" means such average particle diameter that is obtained from particle volume, which can be measured with the use of Coulter method.

The intermediary transfer belt unit comprises: an intermediary transfer belt 8 which is an intermediary transferring member; a drive roller 9; a tension roller 10 as one of suspension-tension roller; and an opposing roller 28. The intermediary transfer belt 8 is an electrically conductive endless belt. It is formed of a material formed by adding electrically conductive agent into a resinous substance. It is 250 mm in measurement (which may also be referred to as width) in terms of the front-to-rear direction of FIG. 1 (which hereafter will be referred to as widthwise direction, and 712 mm in circumference. The intermediary transfer belt 8 is suspended and tensioned by a combination of the drive roller 9, the tension roller 10, the opposing roller 28, being given a total amount of tension of 100N by the tension roller 10. On the inward side of the loop which the intermediary transfer belt 8 forms, primary transfer rollers 6Y, 6M, 6C and 6K, which are primary transferring members, are positioned so that they oppose the photosensitive drums 1Y, 1M, 1C and 1K, respectively, to which transfer voltage is applied by a voltage applying means (unshown).

The image forming apparatus is provided with two optical sensors 27, which are detecting means. One of the two optical sensors 27 is positioned 100 mm outward from the widthwise center of the intermediary transfer belt 8 in terms of the widthwise direction, and the other is on the other side of the center, 100 mm away from the center of intermediary transfer belt 8. Each optical sensor 27 detects the outward surface of the intermediary transfer belt 8, or a calibration patch, which is a toner image formed on the intermediary transfer belt 8, for calibration. The result of the detection of the calibration patch by the optical sensor 27 is used to adjust the image forming apparatus in image density or the like.

Each photosensitive drum 1 rotates in the direction (clockwise direction) indicated by an arrow mark. The intermediary transfer belt 8 is rotated in the direction indicated by an arrow mark Z (counterclockwise direction) by the drive roller 9 as the drive roller 9 is driven by a driving means (unshown). The direction indicated by arrow mark Z may also be referred to simply as rotational direction Z. As positive voltage is applied to the photosensitive drum 6, the toner image on the photosensitive drum 1 (image bearing member) is transferred (which hereafter may be referred to as primary transfer) onto the intermediary transfer belt 8. It is the toner image on the photosensitive drum 1Y that is transferred first (primary transfer) onto the intermediary transfer belt 8, and then, the toner image on the photosensitive drum 1M, and so on, in such a manner that the four toner images, which are different in color, are placed in layers on the intermediary transfer belt 8, yielding thereby a full-color toner image. Then, the layered four monochromatic toner images, or a single full-color toner image, is conveyed to the second transferring portion (secondary transfer nip), which is the interface between second transfer roller 11 as the second transferring member, and the opposing roller 28.

Feeding-conveying apparatus 12 has: a feed roller 14 which feeds sheets S of recording medium in a feeder cassette 13, into a sheet passage; and a pair of conveyance rollers 15 for conveying sheet S as the sheet S is fed into the main assembly of the image forming apparatus. As the sheet S is fed into the main assembly of the image forming apparatus from the feeding-conveying apparatus 12, it is conveyed to the secondary transferring portion by a pair of registration rollers 16 (which hereafter will be referred to as registration roller pair). In order to transfer the toner image on intermediary transfer belt 8 onto sheet S, positive voltage is applied to a secondary transfer roller 11, whereby the toner image on the intermediary transfer belt 8 is transferred (which hereafter is referred to as secondary transfer) onto the sheet S which is being conveyed. After the transfer of the unfixed toner image onto the sheet S, the sheet S is conveyed to a fixing apparatus 17, in which the sheet S and the toner images thereon, are heated and pressed by a combination of a fixation film 18 and a pressure roller 19. Consequently, the toner images become fixed to the surface of the sheet S. Then, the sheet S is discharged out of the image forming apparatus by a pair of discharge rollers 20.

After the fixation of the toner images to the sheet S, the toner (which hereafter will be referred to as primary transfer residual toner) which is remaining on the peripheral surface of the photosensitive drum 1 is removed by the drum cleaning blade 4. As for the toner which is remaining on the intermediary transfer belt 8 (which hereafter will be referred to as secondary transfer residual toner) is scraped away (the intermediary transfer belt 8 is cleaned) by a cleaning blade 21 which is a cleaning member, as intermediary transfer belt 8 rotates in the arrow mark Z direction. Then, the scraped away toner, or waste toner, is recovered into waste toner recovery container 22. Cleaning blade 21 is 240 mm in length (measurement in terms of lengthwise direction), and 2 mm in thickness. It comprises a piece of zinc-plated steel plate which is 230 mm in length, and a urethane rubber blade which is 2 mm in thickness, 77 degrees in JIS K 6253) in hardness, and is pasted to the piece of steel plate. The cleaning blade 21 is kept pressed against the tension roller 10, with the placement of the intermediary transfer belt 8 between itself and the tension roller 10, by a linear pressure of 0.49 N/c, in the counter direction, which is such a direction that its cleaning edge is on the upstream side of its base portion in terms of its rotational direction.

Hereinafter, a toner image formed on the intermediary transfer belt 8 to be supplied, as a lubricating toner image, to the cleaning edge of the cleaning blade 21 to reduce the friction between the cleaning blade 21 and the intermediary transfer belt 8 will be referred to as a lubricating toner image. Further, the toner, of which the lubricating toner image is formed, and which is supplied to the cleaning edge of the cleaning blade 21, is referred to as lubricating toner. In the first embodiment, a half-tone image, for example, is formed as a lubricating toner image, on the intermediary transfer belt 8. In terms of the rotational direction of the intermediary transfer belt 8, the cleaning blade 21 is positioned on the downstream side of the secondary transfer nip. Therefore, a lubricating toner image is formed after the sheet S moves through the second transfer nip, with such timing that the sheet S moves through the secondary transfer nip after the secondary transfer voltage is changed in polarity to the negative one, which is opposite from the one for the normal image formation, to be supplied to the cleaning edge of the cleaning blade 21. The structure and movement of the lubricating toner image will be described later in detail.

A control circuit board substrate 25 is a substrate on which an electric circuit for controlling the image forming apparatus is mounted. It is on the control circuit board substrate 25 that the CPU 26 is mounted as a controlling portion. The CPU 26 controls an intermediary transfer belt driving motor (unshown) which is a power source for driving intermediary transfer belt 8. It controls also a driving power source (unshown) for the feeding-conveying apparatus 12, the registration roller pair 16, the fixing apparatus 17, and a drum motor which is the power source for a process cartridge P. Moreover, the CPU 26 controls the entirety of various operations of the image forming apparatus, for example, various image formation signals related to image formation, image density adjustment based on the result of detection by the optical sensor 27, trouble detection, etc.

[Control of Supplying of Lubricating Toner]

Figure 2:
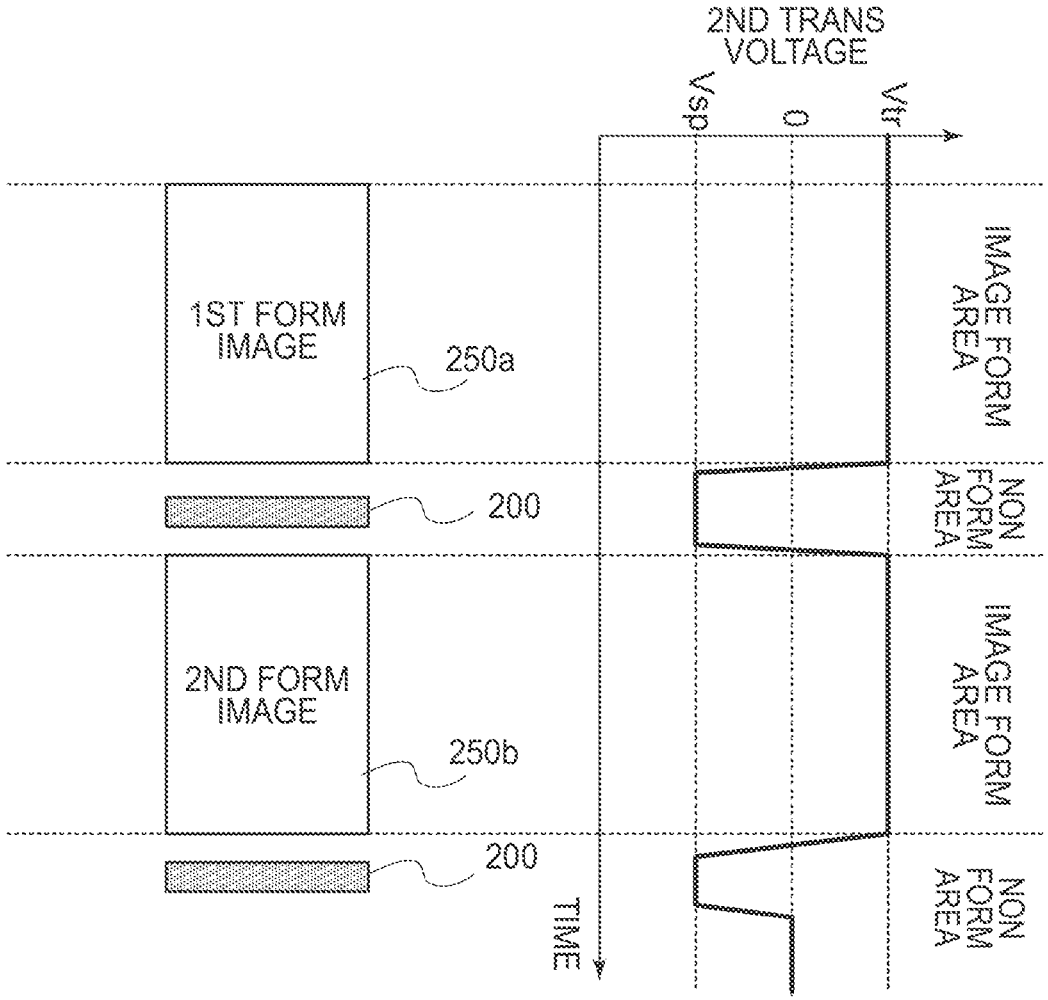
FIG. 2 is a drawing for showing the relationship among the timing with which an ordinary image is formed, timing with which a lubricating toner image is formed, and polarity of the secondary transfer voltage.

Next, referring to FIG. 2, the structure and movement of the lubricating toner image are described. FIG. 2 is a drawing for showing the relationship between the toner images (ordinary toner images and lubricating toner images) on intermediary transfer belt 8 and the secondary transfer voltage, in an image forming operation. In the right graph in FIG. 2, the horizontal axis represents time, and the vertical axis represents the secondary transfer voltage. The left side of FIG. 2 shows the relationship between the elapse of time and the toner images formed on the intermediary transfer belt 8. Referring to FIG. 2, image formation periods are the periods during which an intended toner image is formed on the sheet S. On the other hand, non-formation periods are the periods between the two consecutive image formation periods (which hereafter will be referred to as image formation interval period), which corresponds to the rotational direction of the intermediary transfer belt 8.

Referring to FIG. 2, as the image forming apparatus receives a job for printing an image on two or more sheets S of recording medium, a toner image 200, which is a lubricating toner image, is formed on the portion of the intermediary transfer belt 8, which is between the portion of the intermediary transfer belt 8, across which a normal toner image 250*a* is formed, and the next portion of the intermediary transfer belt 8, across which another normal image 250*b* is formed, and the portion of the intermediary transfer belt 8, which is on the immediately downstream side of the intermediary transfer belt 8, across which the normal toner image 250*b* is formed. First and second normal toner images 250*a* and 250*b* will be referred to as first and second normal toner images, whereas the lubricating toner image 200 will be referred to as the first toner image. By the way, in the first embodiment, in order to prevent the image forming apparatus from reducing in throughput, the lubricating toner is supplied between two consecutively image forming operation. However, this embodiment is not intended to limit the present invention in scope. That is, the lubricating toner may be supplied with other timing than the one in this embodiment. For example, it may be supplied immediately before the image forming operation for forming the normal image is started, or immediately after an image forming operation for forming the normal image is finished. In other words, the lubricating toner image 200 is formed on the portion of the intermediary transfer belt 8, across which the normal toner image is not formed, that is, the portion of the intermediary transfer belt 8, which is between an image forming portion of the intermediary transfer belt 8, and the next image forming portion of the intermediary transfer belt 8. In a case where an ordinary image is formed on the sheet S of LTR size by the image forming apparatus in the first embodiment, the image formation area is 279.4 mm in length, whereas the non-image formation area is 30.6 mm, in terms of the rotational direction of the intermediary transfer belt 8. Thus, a throughput of 60 ppm can be achieved at a process speed of 310 mm/s.

While the portion of the intermediary transfer belt 8, across is which an ordinary image is formed, and the portion (upstream side of portion of the intermediary transfer belt 8, across which first ordinary image 250*a* is formed, in FIG. 2) of the intermediary transfer belt 8, across which the lubricating toner image 200 is formed, are moved in contact with the second transfer roller 11, second transfer voltage Vtr (positive in polarity) is applied to the second transfer roller 11. On the other hand, while the non-image formation area of the intermediary transfer belt 8, which has the lubricating toner image 200, is in contact with the second transfer roller 11, second transfer voltage Vsp (negative) which is the same in polarity as toner is applied to the second transfer roller 11. Thus, the particulate toner particles, of which the lubricating toner image 200 is formed, is prevented from adhering to the second transfer roller 11. In this embodiment, second transfer voltages Vtr and Vsp are 1000 V and −1000 V, respectively, for example. However, even if such voltage that is the same in polarity as toner is applied to the second transfer roller 11, it sometimes occurs that a minute amount of toner adheres to the second transfer roller 11. As toner adheres to the second transfer roller 11, this toner transfers onto the second transfer roller side surface of the next sheet S (back surface soiling occurs). In the first embodiment, in order to better lubricate the cleaning edge of the cleaning blade 21 while preventing the occurrence of back surface soiling, the lubricating toner image 200 is differently formed from an ordinary image.

[Structure of Lubricating Toner Image]

Figure 3:
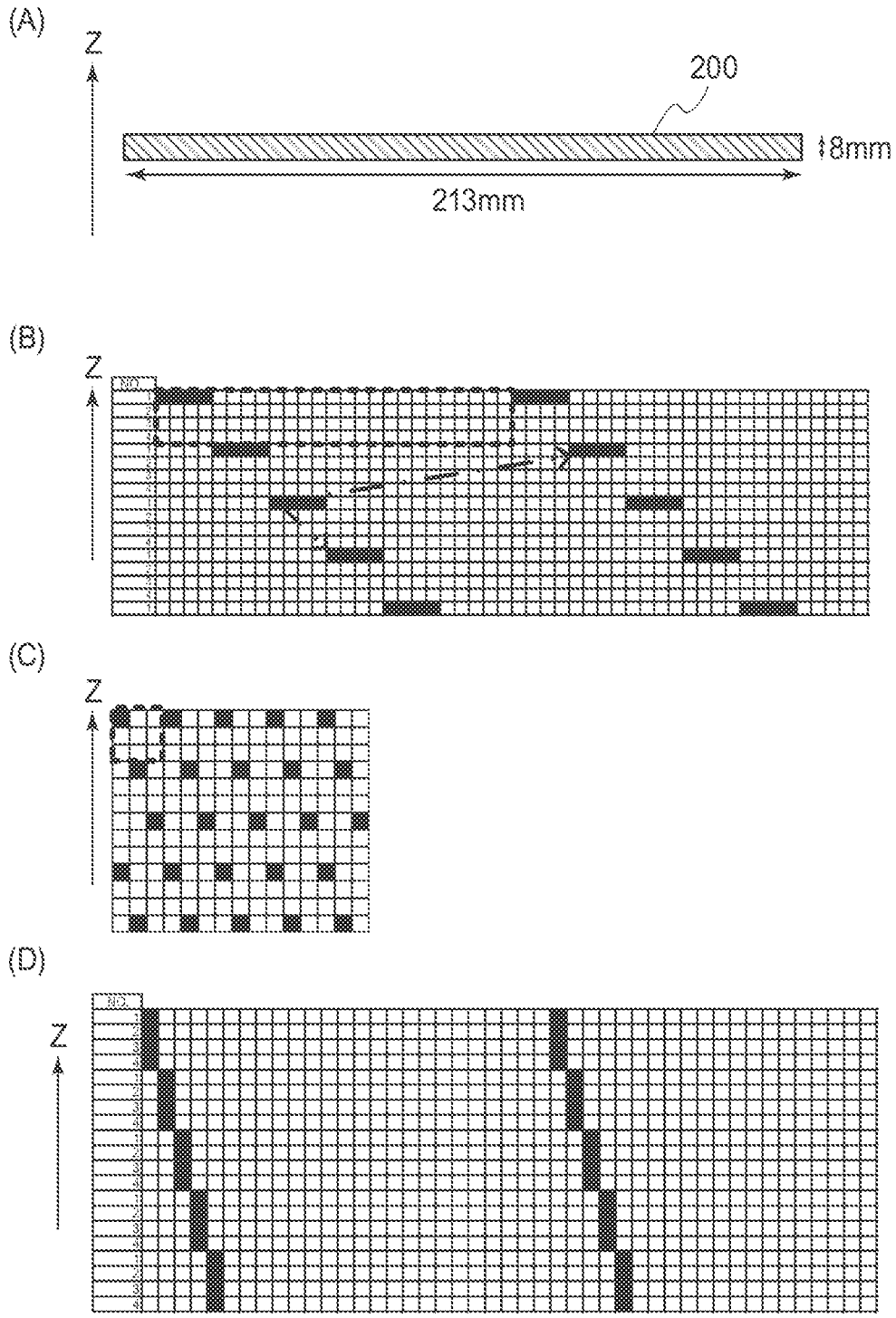
FIG. 3, part(A), part(B), part (C) and part(D), is a combination of a drawing of a toner image for lubrication in the first embodiment, a drawing of the dot pattern of the toner image for lubrication in the first embodiment, and a drawing of the dot pattern in the second comparative toner image for lubrication.

Next, referring to FIG. 3, the lubricating toner image 200 in the first embodiment is described. FIG. 3(A) shows the size of lubricating toner image 200. FIG. 3(B) shows the dot position matrix of lubricating toner image 200. FIG. 3(C) shows the dot position matrix of an ordinary half-tone image. Referring to FIG. 3(A), the lubricating toner image 200 is 8 mm in measurement in terms of the rotational direction Z of the intermediary transfer belt 8, and 213 mm in terms of the widthwise direction of the intermediary transfer belt 8. It is formed of only yellow toner, at a predetermined printing ratio, for example, 4%.

The area indicated by a broken line in FIG. 3(B) is the base unit of the lubricating toner image 200, which is repeatedly formed to yield lubricating toner image 200. Its dot count is the product of the first dot count, which is the dot count in the primary scan direction, and the second dot count, which is the dot count in the secondary scan direction. In the first embodiment, the size of the base unit is such that it has four dots in terms of the rotational direction of the intermediary transfer belt 8 (secondary scan direction), and 25 dots in terms of the widthwise direction of the intermediary transfer belt 8 (primary scan direction), totaling 100 dots. In terms of the secondary scan direction, integer (which is one in first embodiment) multiple of the number (four in first embodiment) of light emitting points is the base unit which is repeated. A dot, to which toner is adhered, in other words, a dot, which corresponds in position to a light emitting point which emits light, is formed at an interval which is equal to the product of the dot interval obtainable from the resolution of the image forming apparatus, and the base unit count in terms of the primary scan direction and the base unit count in the secondary scan direction.

In the first embodiment, printing ratio of 4% is achieved by consecutively forming four dots in the widthwise direction of intermediary transfer belt 8, out of 4×25 dots, that is, 100 dots, starting from the top-left corner. By the way, the direction in which dots are consecutively formed is referred to as "dot growth direction". The dot growth direction in FIG. 3(B) coincides with the primary scan direction. Further, the laser unit 7 has a light source, and each light source has four light emitting points, as described above. Therefore, scanning once in the primary scan direction can form four consecutive dots in the secondary scanning direction. Here, the four light emitting points (each of which emits beam of laser light) can form four dots will be referred to as No. 1-No. 4, respectively. Shown in FIG. 3(B) are such dots that correspond to light emitting points No. 1-No. 4, one for one.

Further, in terms of the rotational direction Z (secondary scan direction) of the intermediary transfer belt 8, the base unit which has 4×25 dots is repeatedly formed in such a manner that the set of four consecutive dots formed during a given scan in the primary scan direction are offset in the primary scan direction by four dots from the set of four consecutive dots formed during the immediately preceding scan in the primary scan direction. A dot pattern such as the one described above, that makes it possible to yield lubricating toner image 200 such as the one described above will be referred to simply as "dot pattern". In the first embodiment, the lubricating toner image 200 is formed by repeatedly forming the base unit which is 8 mm×213 mm in size and has a dot pattern which is 4% in printing ratio. The dot pattern in the first embodiment is 600 dpi in resolution. It is adjusted in tone by adhering toner to a predetermined number of dots positioned in a predetermined pattern, for every 100 dots. Thus, it is equivalent in line count (first line count) to an image which is 60 lpi.

Regarding the definition of line count, the parallelogram contoured by a single-dot chain line in FIG. 3(B), which is made up of two vectors, is the base unit for dot formation forming the lubricating toner image 200. It sometimes occurs that the measurements of the parallelogram in the two directions are expressed in the form of line count. Further, it sometimes occurs that a rectangle is used as the shape of the base unit, and resolution/square root of size of rectangle (value obtained by dividing resolution by square root of base unit) is expressed as line count. In the first embodiment, the latter (base unit is in form of rectangle) is used as the definition of line count. By the way, in the first embodiment, laser unit 7 has four light emitting points, and each of its scanning movement in the primary scan direction causes four beams of laser light to scan the peripheral surface of photosensitive drum 1 in the primary scan direction. Therefore, only one (which is equivalent to No. 1) out of the four light emitting points is used to form dots.

On the other hand, when an ordinary image is printed on the sheet S of recording medium, tone is achieved with the use of 3×3 dot pattern (area contoured in broken line in FIG. 3(C) being used as base unit. In the case of the pattern shown in FIG. 3(C), toner is adhered to only one dot out of 3×3 dots, that is, nine dots. Therefore, it is roughly 11% in printing ratio. In a case where it is necessary to form an image which is no more than 11% in printing ratio, such dots that are smaller than the normal dot described above are formed to realize a desired tone, the laser light source is reduced in the length of time it emits laser light, by pulse width modulation (PWM). In an image forming operation for forming an ordinary image described above, which is 600 dpi in resolution, half-tone is realized by adhering toner to one dot out of every 9 dot area. Therefore, it is equivalent to an image which is 200 lpi, which is equivalent to the second line count.

A low line count pattern such as the one shown in FIG. 3(B) is rather large in the size of the collection of discrete dots for tone expression, and therefore, image structure (half-tone dots) is visible. Therefore, it cannot be used for the formation of an ordinary image. On the other hand, when a lubricating toner image is formed, visibility of the image structure (half-tone dots) does not need to be concerned. That is, dot stability may be prioritized. Therefore, a dot pattern with low line count can be used.

Effects of Embodiment 1

Next, the effects of the first embodiment is described. Effects of the first embodiment was confirmed by forming text images which is 5% in printing ratio, using GF-0081 (product of Canon) of A4 size as recording medium, 5,000 images per day, until image count reaches 50,000. Hereinafter, forming 5,000 images will be referred to as 5,000 sheet conveyance. Further, it may be referred to as sheet conveyance endurance test. In order to test lubricating toner image 200 in lubricity, the amount of torque necessary to drive, that is, the amount of resistance which comes from the friction between the cleaning blade 21 and the intermediary transfer belt 8, is measured as the amount of torque necessary to rotate the drive roller 9, every day, before and after the sheet conveyance endurance test. Further, in order to confirm the stability in the amount of toner in the lubricating toner image 200, the lubricating toner image 200 (dot pattern) was formed on the sheet S of recording medium (GF-0081). Then, the lubricating toner image 200 on the sheet was measured in the degree of whiteness (amount by which light is reflected by print), before and after conveying 5,000 sheets S of recording medium. The degree of whiteness was measured with the use of a photometer TC-6DS/A (product of Tokyo Denshoku Co., Ltd.). Further, whether or not the back surface soiling occurred to the sheet S is visually evaluated.

In order to confirm the effects of the first embodiment, comparative lubricating toner images which are 4% in printing ratio and are the same in the line count as an ordinary image shown in FIG. 3(C), are evaluated. Further, a lubricating toner image which is the same in line count and printing ratio as the lubricating toner image 200 in the first embodiment, but is different in the dot growth direction (its dot growth direction is the same as rotational direction Z of intermediary transfer belt 8 (secondary scan direction), was formed as the second comparative example of lubricating toner image, and evaluated. Next, referring to FIG. 3(D), the structure of the second comparative lubricating toner image is described. The base unit of the second comparative example of lubricating toner image has 4×25 dots. Its printing ratio of 4% was realized by adhering toner to four consecutive dots aligned in the rotational direction Z of intermediary transfer belt 8, starting from the first dot of the top row (line). Further, a repetitive dot pattern which is 8 mm×213 mm in size and 4% in printing ration was formed by repeatedly forming the base unit while shifting the consecutive four dots by an amount equivalent to one dot in the primary scan direction. In the case of the dot pattern shown in FIG. 3(D) which is 600 dpi in resolution, tone is achieved by adhering toner to predetermined number of dots per 100 dots. Therefore, its line count is 60 lpi which is the same as the one in FIG. 3(B).

Figure 4:
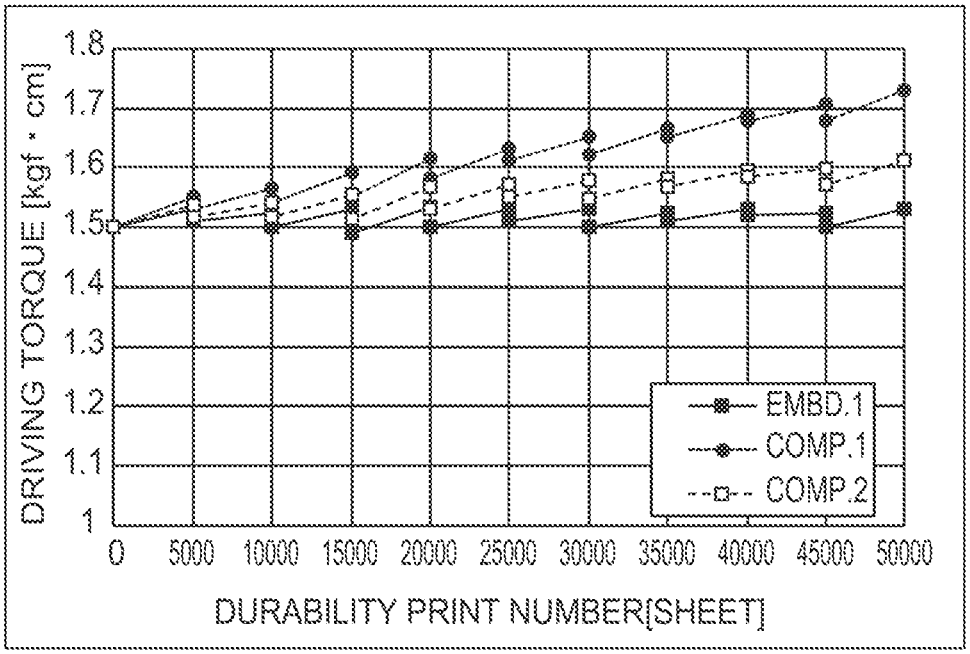
FIG. 4, part(A) and part(B), is a combination of a graph which shows the relationship among the number of sheets of recording medium conveyed, amount of torque necessary to drive the intermediary transfer belt, and the degree of whiteness of sheet of recording medium, in the first embodiment and the first and second comparative embodiments.
Figure 4:
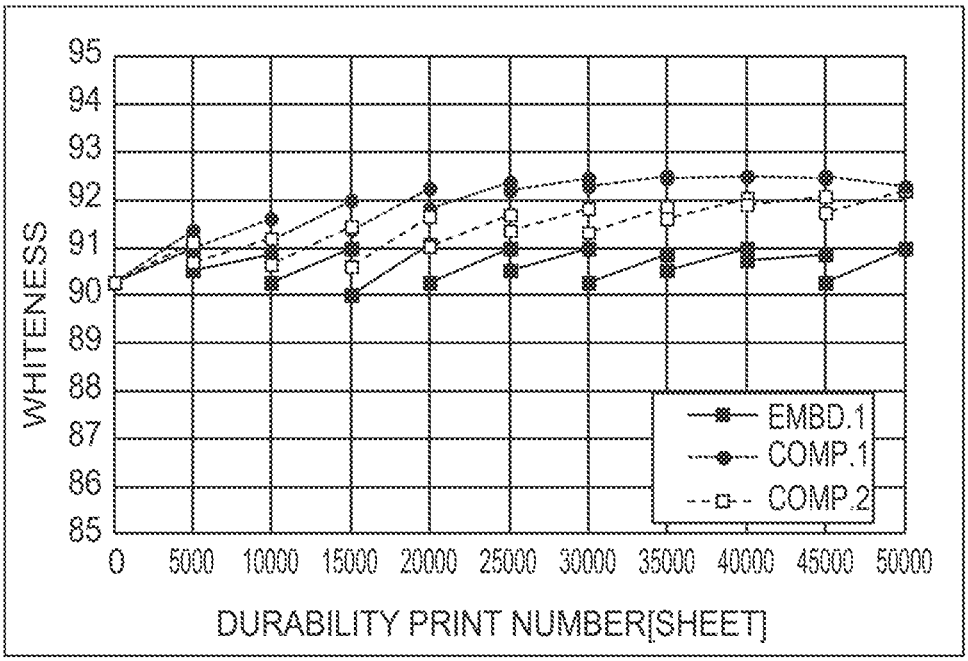

FIG. 4(A) shows the changes in the amount of torque necessary to drive the intermediary transfer belt 8, and the degree of whiteness of lubricating toner image, which were measured during the image forming operation in which the lubricating toner images 200 in the first embodiment were formed, the image forming operation in which the first comparative example of lubricating toner images were formed, and the image forming operation in which the second comparative example of lubricating toner images were formed. In FIG. 4(A), the horizontal axis represents the cumulative number of conveyed sheets, and the vertical axis represents the amount of torque [kgf·cm] which was necessary to drive the intermediary transfer belt 8. Further, black square represents the first embodiment; black circles, the first comparative example; and the white squares represent the second comparative example. As is evident from FIG. 4(A), in the case of the structure of the lubricating toner image in the first embodiment, the changes in the amount of torque necessary to drive the intermediary transfer belt 8 was more stable than in the case of the first and second comparative examples of the lubricating toner image, confirming that the lubricating toner image 200 remained stable in lubricating effect. The structure of the first comparative example of lubricating toner image can also reliably provide lubricating effect, although it is slightly inferior to the lubricating toner image 200 in the first embodiment, which is higher in the line count.

In FIG. 4(B), the horizontal axis represents the cumulative number of sheets conveyed, and the vertical axis represents the degree of whiteness. The legends in FIG. 4(B) are the same in meaning as those in FIG. 4(A). Referring to FIG. 4(B), the first embodiment is most stable in the rate of change in the degree of whiteness of the lubricating toner image 200. The next was the second comparative example of lubricating toner image, and the last was the first comparative example of lubricating toner image. The degree of whiteness was 93 when the printing ratio was 0%, that is, when a sheet of CFE-0081 was measured with no dot filled with toner, indicating that the lower the degree of whiteness in value, the greater the amount by which lubricating toner was supplied, and the closer to 93 in value, the smaller the amount by which lubricating toner is supplied. Further, when the lubricant toner image 200 is 4% in printing ratio, the sheet S was 90.2 in degree of whiteness, indicating that the closer is the sheet S to 90.2 in degree of whiteness, the closer to the target value is the amount by which toner is supplied for lubrication.

Paying attention to the changes in the degree of whiteness, immediately after the conveyance of 5,000 sheets was ended each day, the sheet S was slightly higher in the degree of whiteness, and the amount by which toner was supplied for lubrication was slightly smaller than the target value, making it reasonable to think that these results are attributable to the fact that as the image forming apparatus increased in the cumulative number of sheets conveyed through the apparatus, the photosensitive drum 1 increased in temperature, reducing therefore in electrical resistance. Consequently, the charge current increased; the charge voltage became higher; and therefore, it became difficult to form latent dots on the photosensitive drum 1 (it was difficult to reduce latent image in voltage); and therefore, the latent image became high in voltage. On the other hand, in the case of the lubricant toner image 200 in the first embodiment, the image forming apparatus remained stable in the degree of whiteness of the lubricant toner image 200 throughout the conveyance of 50,000 sheets of recording medium, although slight changes were noticeable.

In comparison to the lubricating toner image 200 in the first embodiment, the first comparative example of lubricating toner image seemed to have continuously changed in the degree of whiteness throughout a day. Further, it gradually increased in the degree of whiteness, indicating that as the sheet conveyance count increased, the amount by which it supplied the cleaning edge of the leaning blade with lubricating gradually fell below the target value. This seemed to have occurred for the following reasons. That is, as the image forming apparatus increased in the cumulative number of conveyed sheets, it also increased in the amount by which its photosensitive drums 1 were shaved. Therefore, the peripheral surface of the photosensitive drum 1 became higher in potential level (which hereafter will be referred to as drum potential level). Therefore, it became difficult for the image forming apparatus to form a latent dot on the photosensitive drum 1. In the case of the first comparative example of the lubricating toner image, a latent dot image, which is smaller than a full-size dot image was formed by PWM process. Therefore, it was more likely to be affected by the change in drum potential level. This theory seems to be reasonable.

Similarly, the second comparative example of lubricating toner image continuously changed in the degree of whiteness throughout a day; it increased in the degree of whiteness as the cumulative number of the conveyed sheets increased, although it was better than the first comparative example of lubricating toner image. This seemed to have occurred for the following reason. That is, lubricating toner image 200 in the first embodiment was made lower in line count, in order not to use a latent dot, which is smaller in size than a full-size dot. As a result, it became unlikely for a dot to be affected in size by the change in the drum potential level. On the other hand, the reason why the second comparative lubricating toner image was greater in the change which occurred as the number of the conveyed sheets increased seems to be attributable to the fact that it was structured to grow dots in the rotational direction Z.

Figure 5:
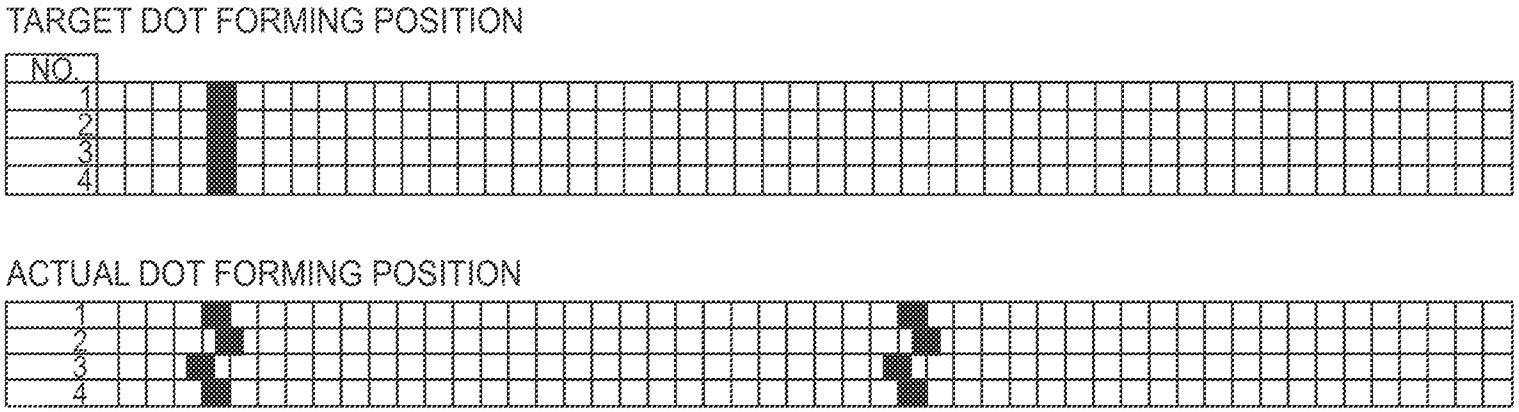
FIG. 5 is a drawing for showing the idealistic dot positions and actual dot position in the second comparative embodiment.

In the case of the second comparative example of the lubricating toner image 200, the four light emitting points are slightly different in the position at which they started writing in terms of the primary scan direction. Therefore, the latent images are slightly different in their position in terms of the primary scan direction, being therefore more likely to become isolated from each other. This theory also seems to be reasonable. FIG. 5 shows the target dot formation positions and the actual dot formation positions of the second comparative example of lubricating toner image 200. In reality, the dots formed by lasers No. 2 and No. 3 are offset left and right, respectively, by 0.5 dot. As a result, the latent dots became discrete as a whole, becoming therefore likely to be affected by the changes in the drum potential level. This theory also is reasonable. Further, the back soiling of sheet S was not visible in any of lubricating toner image 200 in the first embodiment, and first and second comparative examples of lubricating toner image; the back surface soiling did not occur.

As described above, the lubricating toner image 200 in the first embodiment, and the second comparative example of the lubricating toner image were made lower in line count than an ordinary image, making it possible to satisfactorily lubricate the cleaning edge of the cleaning blade (that is, image bearing surface of the intermediary transfer belt 8) while preventing the sheet S from being soiled on its back surface.

Further, in the first embodiment, four dots formed in alignment in the secondary scan direction by the four light emitting points of the light source, one for one, were used as the basic unit which is repeated to form lubricating toner image, and only laser No. 1 was used to make the basic unit grow in the primary scan direction. Therefore, lubricating toner image 200 is not affected by the shifting of dots in the primary scan direction of each light emitting point. Therefore, it was possible to confirm that the cleaning edge of the cleaning blade was more reliably lubricated.

By the way, the lubricating toner image 200 in the first embodiment was in the form of a rectangle which is 8 mm×213 mm in size. However, the lubricating toner image 200 may be different in shape from the one in the first embodiment. That is, a lubricating toner image which is different in shape from the one in the first embodiment may be used in place of the lubricating toner image 200. Employment of such lubricating toner image can also provide the same effects as those provided by the lubricating toner image 200 in the first embodiment. The dimension of the lubricating toner image 200 in the rotational direction Z of the intermediary transfer belt 8 can be determined with the use of the following method. That is, it can be determined in consideration of the length of time necessary to increase the secondary transfer voltage from Vtr to Vsp, during the period which corresponds to the period in which no image is formed, which can be obtained from the relationship between the process speed and the desired throughput. In the case of the first embodiment, in consideration of the length of time it takes to increase or decrease the secondary transfer voltage, it is possible to form a lubricating toner image, which is roughly 20 mm in the dimension in terms of the rotational direction Z of the intermediary transfer belt 8, across the area of the intermediary transfer belt 8, across which no ordinary image is formed, and which is 30.6 mm in terms of the rotational direction Z of the intermediary transfer belt 8. By the way, the lubricating toner image 200 is desired to be as wide as possible while being less in dimension than the cleaning blade 21 in terms of the widthwise direction of the intermediary transfer belt 8. From the standpoint of preventing the cleaning edge of leaning blade from becoming uneven in the widthwise direction of the intermediary transfer belt 8, in the amount by which it is provided with lubricating toner, the shape of the lubricating toner image is desired to be in the form of a rectangle, a parallelogram, or the like.

Further, in the first embodiment, yellow toner was used to form the lubricating toner image 200. However, toner of one of the other color may be used. The result of usage of toner of other color can provide the same effects as those obtained by the first embodiment. From the standpoint of conspicuousness of back soiling, yellow toner is advantageous. That is, it is possible that using toner of one of the other colors than yellow to form the lubricating toner image 200 will make back soiling more conspicuous than yellow. However, toner color has little to do with lubricity of the lubricating toner image 200. That is, even if toner of one of the other color than yellow is used to form the lubricating toner image 200, its effects are the same as those obtained by the first embodiment.

Further, in the first embodiment, back soiling was prevented by applying such voltage that is opposite in polarity from the voltage applied when forming an ordinary image, to the second transfer roller 11. However, even if a back soiling preventing means other than the one in the first embodiment is used, the same effects as those obtained by the first embodiment can be obtained. For example, structuring an image forming apparatus so that the second transfer roller 11 is mechanically separated from the intermediary transfer belt 8 while the portion of the intermediary transfer belt 8, across which no ordinary image is formed, is moving through the secondary transferring portion, can provide the same effects as those obtainable by the first embodiment. As described above, the first embodiment can ensure that not only is intermediary transfer belt 8 is reliably cleaned while preventing the back soiling.

Next, another example of image forming apparatus is described. In the second embodiment, in order to reduce an image forming apparatus in cost by simplifying the apparatus in structure, the laser unit 7 was reduced in the number of its laser (light emitting point) of its light source from four to two.

(Structure of Image Forming Apparatus)

The image forming apparatus in the second embodiment is different in structure from the one in the first embodiment shown in FIG. 1, in that its laser unit 7 has only two light emitting points instead of four. Thus, its laser unit 7 repeatedly scans the peripheral surface of the photosensitive drum 1 with a set of two beams of laser light to form an image. It has not been changed in process speed from the one the first embodiment. Thus, the motor (unshown) in the scanner unit of the image forming apparatus in this embodiment was made greater in rotational speed. As far as the control of lubricating toner supply, and the size, color, and printing ratio of lubricating toner image 200, are concerned, the image forming apparatus in the second embodiment is the same as the one in the first embodiment.

[Structure of Lubricating Toner Image]

Figure 6:
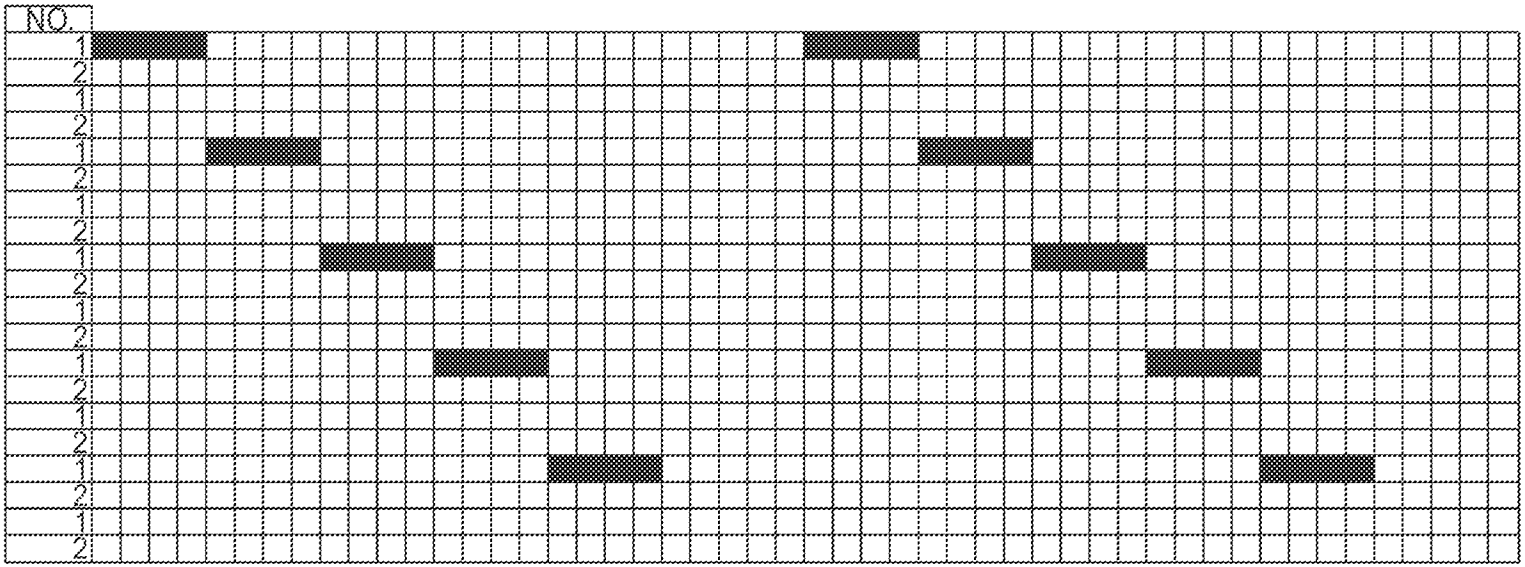
FIG. 6 is the dot pattern in the second embodiment of the present invention.

Next, the lubricating toner image in this embodiment, which characterizes the second embodiment, is described with reference to FIG. 6. Referring to FIG. 6, the lubricating toner image 200 in this embodiment employs the same base unit comprising 4×25 dots like the base unit in the first embodiment. Of its 100 dots, the consecutive four dots in the widthwise direction of the intermediary transfer belt 8, starting from the first dot of the row, filled with toner (lubricating toner). In terms of the secondary scan direction, integer multiple (two times) of light emitting point count (two in second embodiment) was used as the basic unit to be repeatedly formed to yield the lubricating toner image 200.

The dot pattern described above was used to yield a printing ratio of 4%. On the other hand, in the first embodiment, of the four beams of laser light, beams Nos. 2, 3 and 4 are not turned on at all, whereas beam No. 1 is always turned on at one position which corresponds to one of the dots which aligned in the primary scan direction, in terms of the rotational direction Z (secondary scan direction) of the intermediary transfer belt 8. In comparison, in the second embodiment, the image forming apparatus was structured so that beam No. 1 also not turned on for every rotation of the photosensitive drum 1 in the secondary direction to create a dot pattern which is similar to the one in the first embodiment. For example, in FIG. 6, during an odd-numbered scan (first, third and so on), No. 1 is on, but during an even-numbered (second, fourth and so on) scan, even No. 1 is not on. In the second embodiment, in terms of the primary scan direction, the light emitting point is consecutively turned on, but in terms of the secondary scan direction, it is turned on once every odd-numbered scan. By the way, In the second embodiment, the number of the light emitting point is two. However, the number of light emitting point may be one. In the case where the number of light emitting point is one, the light emitting point has only to be turned on once every fourth time. Further, the dot growth direction may be the same direction as the secondary scan direction.

Effects of Second Embodiment

In order to confirm the effects of the second embodiment, a predetermined number of prints were made with the image forming apparatus in the second embodiment, under the same condition as the one under which the image forming apparatus in the first embodiment was used, while measuring the amount of torque necessary to drive intermediary transfer belt 8, degree of whiteness of the lubricating toner image, and occurrence or nonoccurrence of back soiling. As a result, no back soiling occurred. Further, the second embodiment was roughly the same as the first embodiment in the change in the amount of torque necessary to drive the intermediary transfer belt 8, and the change in the degree of whiteness.

As described above, also in the second embodiment, it was possible to reliably lubricate the cleaning edge of the cleaning blade while preventing the occurrence of back soiling, by reducing the image forming apparatus in line count while a lubricating toner image is formed than when an ordinary image is formed, as in the first embodiment.

Moreover, in the second embodiment, four dots, which are twice the number of the light emitting points of the light source was used as the basic unit, which was repeatedly formed to form (grow) dots in the secondary scan direction, and only laser No. 1 was used to form (grow) consecutive four dots. It was confirmed that with this arrangement, the image forming apparatus is not affected by the problem that if the four dots are formed by the four light emitting points, they may be displaced relative to each other in terms of the primary scan direction. Therefore, it was possible to more reliably lubricate the cleaning edge of the cleaning blade.

By the way, like the first embodiment, this embodiment also is not intended to limit the present invention in terms of printing ratio, color, pattern, and size of a lubricating toner image, and the means for preventing back soiling. These properties can be set according to proper printing ratio, color, pattern, size of an image to be formed by each image forming apparatus.

As described above, the second embodiment also can reliably lubricate the cleaning edge of a cleaning blade while preventing a sheet of recording medium from being soiled on its back surface.

According to the present invention, it is possible to reliably clean the intermediary transfer belt of an image forming apparatus while preventing a sheet of recording medium from being soiled on its back surface.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-158687 filed on Sep. 23, 2020, which is hereby incorporated by reference herein in its entirety.

What is claimed is:

1. An image forming apparatus comprising:

an image bearing member;

an exposing unit including a light source and configured to form an electrostatic latent image on said image bearing member with a light beam emitted from said light source;

a developing member configured to develop the electrostatic latent image formed by said exposing unit with toner and to form a toner image;

an intermediary transfer member to which the toner image on said image bearing member is transferred;

a primary transfer member configured to transfer the toner image on said image bearing member to said intermediary transfer member;

a secondary transfer member configured to transfer the toner image on said intermediary transfer member to a recording material;

a cleaning member configured to clean a remaining toner on said intermediary transfer member after transferring the toner image to the recording material by said secondary transfer member; and a controller configured to control so as to form the toner image on said intermediary transfer member to supply the toner as a lubricant of said cleaning member, wherein said controller controls so that (a) a first line count having a first length as a repetition length is used when a first toner image is formed to supply the toner to said cleaning member, and (b) a second line count having a second length as a repetition length, the second length being shorter than the first length, is used when a second toner image is formed to transfer to the recording material.

2. An image forming apparatus according to claim 1, wherein when a base unit is a dot count multiplied by a first dot count with respect to a main scanning direction where said image bearing member is scanned with the light beam and a second dot count with respect to a sub scanning direction perpendicular to the main scanning direction, said controller controls said light source to turn on so as to be a predetermined print rate in the base unit, and wherein said controller controls to form the first toner image by repeating the base unit with respect to the main scanning direction and by repeating the base unit while shifting in the main scanning direction with respect to the sub scanning direction.

3. An image forming apparatus according to claim 2, wherein the first line count and the second line count are a value obtained by dividing a resolution by a square root of the dot count of the base unit.

4. An image forming apparatus according to claim 1, wherein said controller controls to form the first toner image on said intermediary transfer member at a timing before or after forming the second toner image.

5. An image forming apparatus according to claim 1, wherein said controller controls to form the first toner image with yellow color.

6. An image forming apparatus according to claim 1, further comprising, when said image bearing member is a first image bearing member, a second image bearing member.

* * * * *